United States Patent [19]

Bromley et al.

[11] Patent Number: 4,489,543

[45] Date of Patent: Dec. 25, 1984

[54] SELF-CRIMPING YARN

[75] Inventors: James E. Bromley, Pensacola, Fla.; John R. Dees, Charlotte, N.C.; Harold M. Familant, Chesterfield, Mo.; Wayne T. Mowe, Pensacola, Fla.; Darwyn E. Walker, Wilbraham, Mass.

[73] Assignee: Celanese Corporation, New York, N.Y.

[21] Appl. No.: 329,488

[22] Filed: Dec. 10, 1981

Related U.S. Application Data

[60] Continuation-in-part of Ser. No. 206,128, Nov. 6, 1980, abandoned, which is a continuation of Ser. No. 882,290, Feb. 27, 1978, abandoned, which is a division of Ser. No. 825,495, Aug. 17, 1977, abandoned, and a continuation-in-part of Ser. No. 167,164, Jul. 9, 1980, Pat. No. 4,419,313, which is a continuation-in-part of Ser. No. 55,859, Jul. 9, 1979, abandoned, which is a continuation of Ser. No. 825,495, Aug. 17, 1977, abandoned.

[51] Int. Cl.[3] ..... D02G 3/24; D02G 1/18; D01D 5/22

[52] U.S. Cl. ..... 57/208; 57/245; 57/248; 57/905; 264/167; 264/168; 264/171; 264/176 F; 264/177 F; 428/370; 428/371; 428/373; 428/374; 428/399

[58] Field of Search ..... 57/208, 207, 206, 243–247, 57/905, 284, 288, 289; 264/167, 168, 171, 176 F, 177 F, 210 F, 210.8; 428/373, 369, 374, 399, 370, 371

[56] References Cited

U.S. PATENT DOCUMENTS

| | | | |
|---|---|---|---|
| 3,387,327 | 6/1968 | Privott, Jr. et al. | 264/176 F |
| 3,497,585 | 2/1970 | Chapman et al. | 264/171 |
| 3,700,545 | 10/1972 | Matsui et al. | 264/171 |
| 3,744,529 | 7/1973 | Jorda et al. | 264/210 F |
| 3,852,948 | 12/1974 | Ruddell et al. | 57/243 |
| 4,026,098 | 5/1977 | Bosley | 57/208 X |
| 4,059,950 | 11/1977 | Negishi et al. | 57/208 |
| 4,349,604 | 9/1982 | Blackmon et al. | 57/245 X |
| 4,351,147 | 9/1982 | Blackmon et al. | 57/208 |

FOREIGN PATENT DOCUMENTS

| | | | |
|---|---|---|---|
| 2835706 | 2/1979 | Fed. Rep. of Germany . | |
| 42-22576 | 4/1967 | Japan . | |
| 42-22339 | 9/1967 | Japan | 264/177 F |
| 51-58514 | 5/1976 | Japan | 264/177 F |
| 2003423 | 3/1979 | United Kingdom . | |

*Primary Examiner*—John Petrakes
*Attorney, Agent, or Firm*—Herbert M. Adrian, Jr.

[57] ABSTRACT

Polyester polymer is extruded through converging capillaries at different speeds to merge and form a combined stream. The stream is cooled to form a filament, which is withdrawn at a high speed. A plurality of such filaments are combined into yarn which self-crimps upon heating. In some embodiments, the yarn has a variable denier.

7 Claims, 12 Drawing Figures

SELF-CRIMPING YARN

This application is a continuation-in-part of U.S. patent application Ser. No. 206,128 filed Nov. 6, 1980, now abandoned, which in turn is a continuation of U.S. patent application Ser. No. 882,290 filed Feb. 27, 1978 (now abandoned) which in turn is a division of U.S. patent application Ser. No. 825,495 filed Aug. 17, 1977 (now abandoned), and is a continuation-in-part of U.S. patent application Ser. No. 167,164 filed July 9, 1980 now U.S. Pat. No. 4,419,313, which in turn is a continuation-in-part of U.S. patent application Ser. No. 55,859 filed July 9, 1979 (now abandoned) which in turn is a continuation of U.S. patent application Ser. No. 825,495 filed Aug. 17, 1977 (now abandoned). The disclosures of each of these prior applications are incorporated herein by reference.

The invention relates to novel processes for making polyester self-texturing yarns, and to the resulting yarns. More particularly, the process invention relates to such a spinning process wherein molten streams of the same polyester polymer are combined and spun to give novel and useful yarns.

It is known to make self-crimping yarns by combining converging streams of different jet stretch and cooling the combined streams into a filament, followed by a drawing operation. Such prior art processes are disclosed in U.S. Pat. No. 3,387,327 to Privott et al. and U.S. Pat. No. 3,497,585 to Chapman et al, the disclosures of which are incorporated herein by reference. Yarns made according to the Chapman and Privott disclosures have low crimp, and are quite expensive due to low productivity of the disclosed processes.

Japanese patent publication No. 22339/1967 discloses extruding at low spinning speeds various polymers through combined orifices, each combined orifice including a large diameter central capillary and two or more small diameter satellite capillaries, the lengths of the various capillaries being unspecified. The spun yarns are then drawn under unspecified conditions to yield drawn filaments having cross-sectional shapes which vary continuously along the length of each filament. When attempts were made to duplicate the teachings of this reference with polyester polymer, yarn drawn at normal draw ratios and relaxed exhibits a small amount of crimp, but not to a useful degree. When the draw ratio is reduced experimentally to an unusual ratio, the crimp level in the relaxed yarn increases to a marginally useful level. However, fabrics made from either of these yarns have a harsh hand and poor covering power.

According to the invention, these and other difficulties of the prior art are reduced or avoided by the processes disclosed below, and novel self-crimping yarns having remarkably soft, luxuriant hand in fabric form are provided.

Specific aspects of the invention will in part appear hereinafter and will in part be apparent from the following detailed description taken together with the accompanying drawings, wherein.

Figure 1:
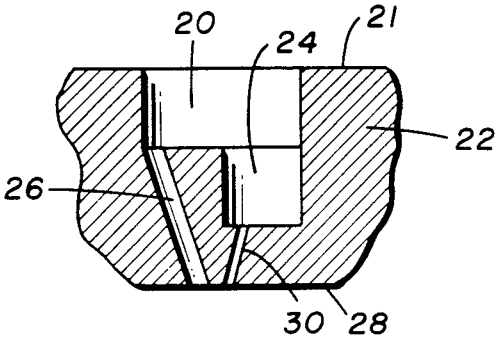
FIG. 1 is a vertical sectional view of the preferred embodiment of a spinneret usable according to the invention.
Figure 2:
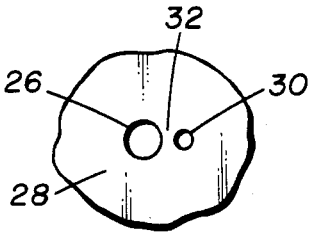
FIG. 2 is a bottom plan view of the FIG. 1 spinneret, looking up.

FIGS. 1 and 2 illustrate an exemplary embodiment of a spinneret design which can be employed according to the invention. The spinneret includes a large counterbore 20 formed in the upper surface 21 of spinneret plate 22. Small counterbore 24 is formed in the bottom of and at one side of large counterbore 20. A large capillary 26 extends from the bottom of large counterbore 20 at the side opposite small counterbore 24, and connects the bottom of large counterbore 20 with the lower surface 28 of plate 22. Small capillary 30 connects the bottom of counterbore 24 with surface 28. Capillaries 26 and 30 are each inclined four degrees from the vertical, and thus have an included angle of eight degrees. Counterbore 20 has a diameter of 0.0625 inch (1.588 mm.), while counterbore 24 has a diameter of 0.031 inch (0.787 mm.). Capillary 26 has a diameter of 0.0165 inch (0.419 mm.) and a length of 0.150 inch (3.81 mm.), while capillary 30 has a diameter of 0.0102 inch (0.259 mm.) and a length of 0.0286 inch (0.726 mm.). Land 32 separates capillaries 26 and 30 as they emerge at surface 28, and has a width of 0.0056 inch (0.142 mm.). Plate 22 has a thickness of 0.554 inch (14.07 mm.). Capillaries 26 and 30 together with counterbores 20 and 24 constitute a combined orifice for spinning various novel and useful filaments according to the invention, as will be more particularly described hereinafter.

Figure 3:
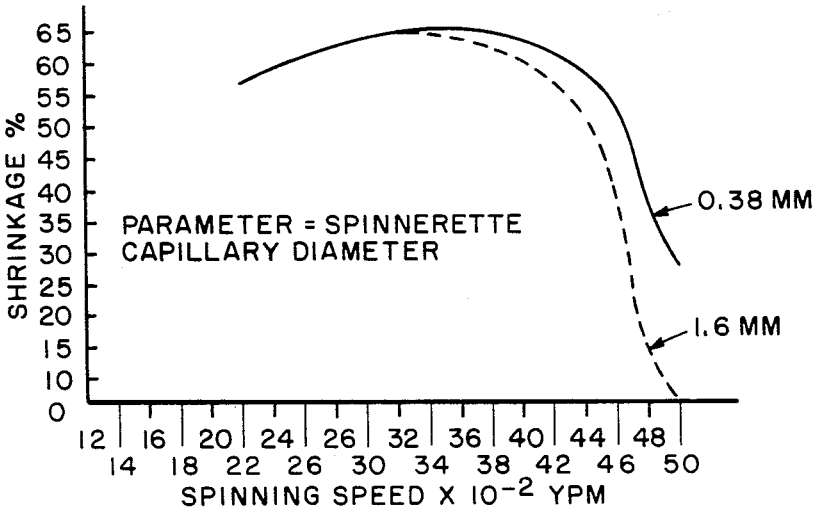
FIG. 3 is a graph of shrinkage versus spinning speed used in explaining the principles upon which certain aspects of the invention are based.

FIG. 3 is a graph showing how polyester filament shrinkage varies with spinning speed for two illustrative cases of jet stretch. The curve in dotted lines shows that the shrinkage falls from about 65% at 3400 ypm (about 3100 mpm) to about 5% at 5000 ypm (about 4500 mpm) when using spinneret capillaries having diameters of 0.063 inch (1.6 mm.) and when simultaneously spinning 34 such filaments to be false-twist draw-textured to yield a textured yarn having 150 denier. The solid curve shows that the shrinkage drops off at higher speeds when using spinneret capillaries having diameters of 0.015 inch (0.38 mm.) when similarly simultaneously spinning 34 such filaments to be false-twist draw-textured to yield a textured yarn having 150 denier. Using different capillary diameters produces a family of curves between, to the left, and to the right of those illustrated. The curves also can be shifted (for a given capillary diameter) by varying the polymer throughput. In other words, the curves can be shifted by varying the jet stretch, which is the ratio of yarn speed just after solidification to average speed of molten polymer in the capillary. It is thus possible to provide a combined orifice for spinning a composite filament of a single polymer wherein one side of the filament has a higher shrinkage then the other side. This is done by selecting the individual capillaries to give different jet stretches, and also selecting the spinning speed within the range wherein an individual filament quenched from one of the individual streams would have a shrinkage at least ten percentage points higher than that of an individual filament quenched from the other of the individual streams. Under the spinning conditions illustrated in FIG. 3, at a spinning speed of 5000 yards per minute the individual streams would have shrinkages differing by about 25 percentage points. Combining these molten streams into a side-by-side configuration results in a filament having latent helical crimp in its as-spun form, without the necessity of drawing the yarn to develop the crimp as in the Privott and Chapman patents noted above. Such combining may be done using a spinneret design similar to those disclosed in Privott and Chapman wherein the two streams merge at or just prior to emergence of the streams from surface 28.

Figure 5:
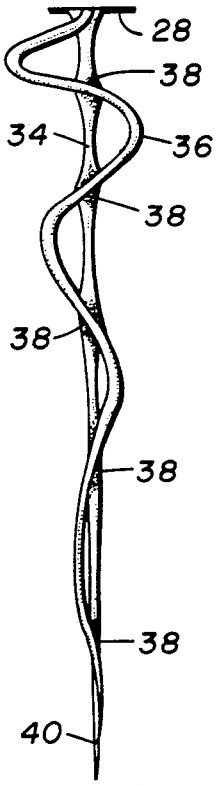
FIG. 5 is a side elevation view of the molten streams issuing from the FIG. 1 spinneret according to certain aspects of the invention.

According to the invention, when a land 32 of appropriate dimension is provided, as with the exemplary spinneret specifically disclosed above, a remarkable phenomenon occurs as illustrated in FIG. 5. Due to the geometry of the spinneret construction, the polymer flowing through the smaller capillaries 30 has a higher velocity than that flowing through the larger capillaries. The speeds and momenta of the paired streams issuing from each combined orifice and the angle at which the streams converge outside the spinneret are such that the slower streams 34 travel in substantially straight lines after the points at which the paired streams first touch and attach, while each of the smaller and faster of the streams 36 forms sinuous loops back and forth between successive points of attachment 38 with its associated larger streams. This action would not occur if land 32 were not sufficiently large (about 0.002 inch in spinnerets of this design), and can be readily observed using a stroboscopic light directed onto the streams immediately below the spinneret face 28. As the molten streams accelerate away from the spinneret, the slower stream attenuates between the points of attachment 38 and the loops of the faster stream become straightened until the faster stream is brought into continuous contact with the slower stream. The slower stream attenuates more between than at the points of first attachment, so that the resulting combined stream has a cross-section which is larger at the points of first attachment than in the regions between these points. The resulting combined stream is then further attenuated somewhat until it is solidified into a filament 40 by the transverse quench air. Each solidified filament 40 has non-round cross-sectional areas which vary repetitively along its length.

Advantageously, the spinneret is so designed that one of the individual streams has a velocity in its capillary between 2.0 and 7 times (preferably between 3.5 and 5.5 times) the velocity of the other of the streams in its capillary. Further advantages are obtained when the faster of the two streams has a smaller cross-sectional area than the slower of the streams, particularly in degree of crimp and spinning stability. Productivity is increased when the spinning speed is selected such that the combined filament has a shrinkage less than 30%, and is maximized when the shrinkage is less than 10%.

EXAMPLE I

Molten polyester polymer of normal textile molecular weight is metered at a temperature of 290° C. through a spinneret having 34 combined orifices as in the exemplary spinneret above specifically disclosed. The polymer throughput is adjusted to produce filaments of 4 average denier per filament at a spinning speed of 5200 yards per minute, the molten streams being conventionally quenched into filaments by transversely directed quenching air.

Figure 4:
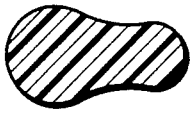
FIG. 4 is a cross-sectional view of a filament according to certain aspects of the invention.

The resulting filaments are combined into a yarn bundle prior to winding. Each of the filaments has a non-round cross-section as illustrated in FIG. 4, the cross-sectional area of which varies substantially regularly along the length of the filament. The variation in cross-sectional area is more than ±30% about the mean value, and the regions of large and small cross-sectional area are out of phase from filament to filament within the yarn bundle. The regions of large cross-sectional area have high shrinkage with at least two consecutive 5 cm. shrinkage amplitudes greater than 40%, while the regions with small area have low shrinkage with at least two consecutive 5 cm. shrinkage amplitudes below 20%. The shrinkage peaks and valleys are out of phase from filament to filament and have amplitudes and spacings such that the yarn has a crimp of 10% and a crimp-to-shrinkage ratio of 0.9.

Figure 6:
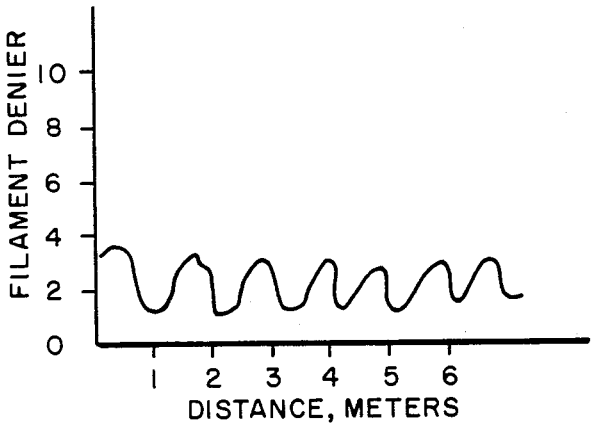
FIG. 6 is a graph illustrating the variation in denier along a representative filament according to certain aspects of the invention.

As illustrated qualitatively in FIG. 6, when using the above spinning conditions, the filament cross-sectional area reptitively varies at a repetition rate of about one per meter, although this can be varied by modifying the spinning conditions and the geometry of the spinneret passages.

Figure 7:
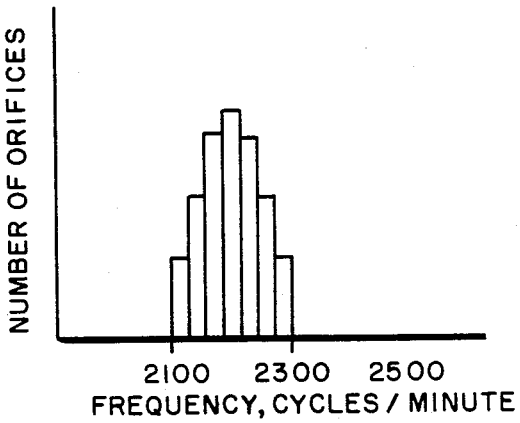
FIG. 7 is a graph illustrating the distribution of the fluctuations illustrated in FIG. 5 for a representative multiple orifice spinneret according to certain aspects of the invention.

Due to minor differences between combined orifices, temperature gradations across the spinneret, and other like deviations from exactly the same treatment for each pair of streams, a multiple orifice spinneret will typically provide somewhat different repetition rates among the several resulting streams and filaments. An example of this is qualitatively shown in FIG. 7, wherein is shown that various orifices produce somewhat different repetition rates as determined by stroboscopic examination of the combined streams just below the spinneret face. In the resulting multifilament yarn, the filaments have non-round cross-sections which vary by more than ±10% along the length of the filaments, the variations in cross-sectional areas being out of phase from filament to filament. When such a yarn is heated under low tension, the high shrinkage regions in a filament contract more than the low shrinkage regions in adjacent filaments, which are placed under compression and forced to bulge out and protrude from the yarn bundle, yielding crimp. If the degree of shrinkage amplitude variations were too small, or if the shrinkage amplitude variations along the filaments were in phase, a useful degree of crimp would not be obtained.

Figure 10:
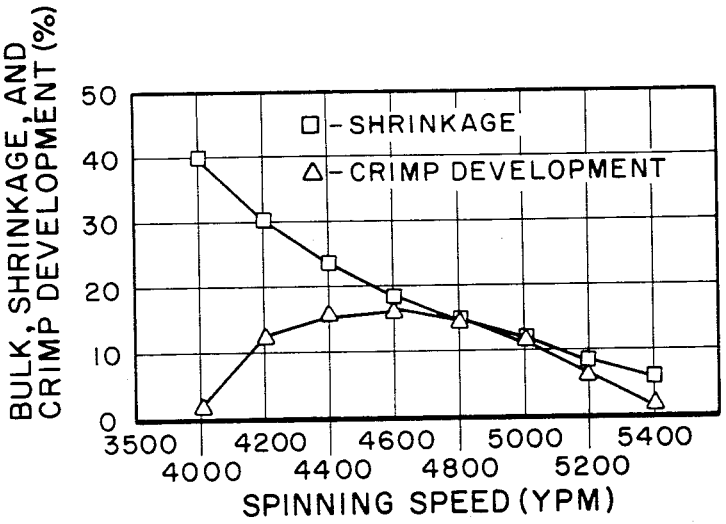
FIG. 10 is a graph showing how shrinkage and crimp vary with spinning speed with one spinneret according to the invention.

Generally speaking, crimp is a desirable property while shrinkage is undesirable. The crimp-to-shrinkage ratio is thus a measure of the general desirability of the yarn. For direct use in most fabrics, this ratio should be above 0.25. Likewise, in most cases the crimp level should be above 3% in order to have a useful effect in the fabric. FIG. 10 shows how crimp and shrinkage vary with spinning speed with a representative spinneret of the FIG. 1 type.

Fabrics made from the yarn of this example exhibit an unusually soft and luxuriant hand and increased covering power, as compared to fabrics formed from conventionally textured (false-twist heat-set) yarns having the same number of filaments and the same average denier per filament.

As an example of an end use for the yarn, the yarn of this example is woven as filling across a continuous filament warp. The fabric is dyed at the boil, shrinking in the process, and is then stretched back to the desired width and heatset on a tenter frame. During the tentering operation, numerous filaments in the filling yarn break and protrude from the fabric, giving the fabric the appearance and hand of fabric made from yarns spun from staple fibers. It is believed that the high shrinkage regions along the filaments become brittle when heated under low tension in the dyebath and that these embrittled regions break during tentering.

EXAMPLE II

The above spinneret design is modified such that capillary 26 has a length of 0.146 inch (0.419 mm.), while capillary 30 has a diameter of 0.092 inch (0.259 mm.) and a length of 0.032 inch (0.726 mm.). The other dimensions for this spinneret are the same as for the spinneret used in Example I, and 34 combined orifices are provided. Molten polyester polymer of normal textile molecular weight is metered at a temperature of 293° C. through the modified spinneret. The polymer throughput is adjusted to produce filaments of 2.5 average denier per filament at a spinning speed of 5000 yards (about 4500 meters) per minute, the molten streams being conventionally quenched into filaments by a uniform flow of transversely directed quenching air.

Figure 8:
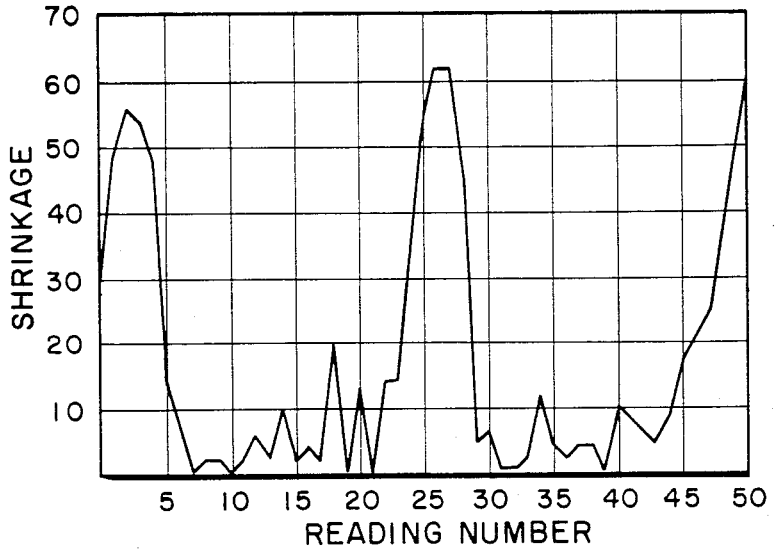
FIGS. 8, 9 and 11 are shrinkage profiles of filaments according to various aspects of the invention.
Figure 9:
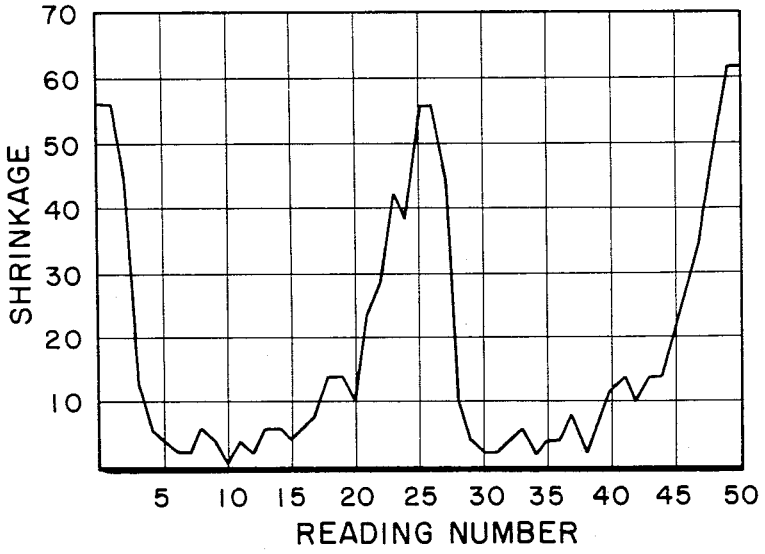

FIGS. 8 and 9 show shrinkage profiles for two randomly chosen filaments of the yarn of this example. As illustrated, each filament length profiled has a plurality of broad shrinkage peaks wherein a plurality of successive 5 cm. segments have shrinkages above 40%, and broad shrinkage valleys between the peaks, the valleys having a plurality of successive 5 cm. segments having shrinkages below 20%. The yarn has a tenacity of 2.6 grams per denier, an elongation-to-break of 59%, a crimp of 8.5% and a shrinkage of 11%.

EXAMPLE III

A spinneret is provided having 60 combined orifices with dimensions as in the Example II spinneret. Polyester polymer of normal molecular weight for apparel end uses is spun through the spinneret at a temperature of 293° C. and the resulting combined streams are conventionally quenched by transversely directed air into filaments at a spinning speed of 3800 yards (about 3400 meters) per minute. The polymer metering rate is adjusted to provide a spun yarn denier of 220. The spun yarn is conventionally textured by the false-twist heat-set process. The filaments in the resulting textured yarn have non-round cross-sections which repetitively vary in area by more than ±10% along the length of the filaments, and alternating S-twisted and Z-twisted helically crimped sections, the variations in cross-sectional area being out of phase from filament to filament and the helically crimped sections being out of phase from filament to filament. Fabrics made from the yarn have a particularly soft and pleasant hand and increased covering power in comparison to fabrics made from a conventional textured yarn having the same number of filaments and the same denier per filament.

Figure 11:
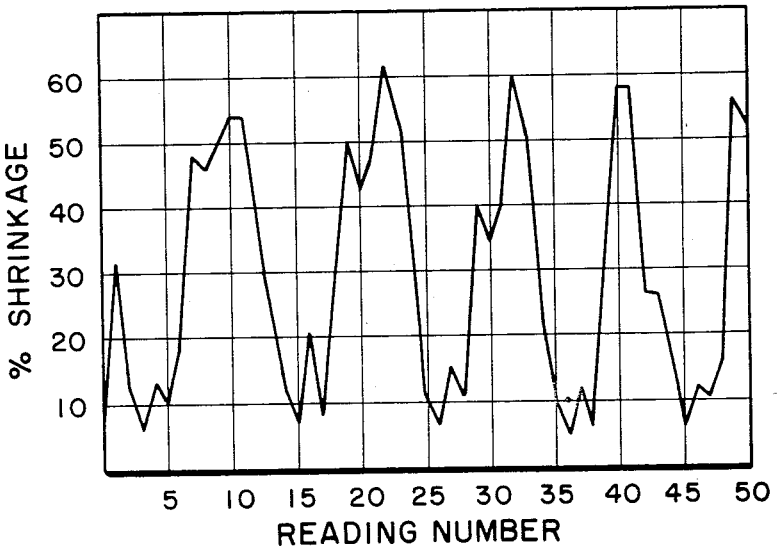

FIG. 11 shows the shrinkage profile along a filament randomly selected from the spun yarn bundle. As in Example I above, the filament has a plurality of broad shrinkage peaks wherein a plurality of successive 5 cm. segments have shrinkage amplitudes above 40%, and shrinkage valleys between the peaks, the valleys having a plurality of successive 5 cm. segments having 5 cm. shrinkage amplitudes at least ten percentage points less than the 5 cm. shrinkage amplitudes of the peaks. The shrinkage peaks and valleys are substantially regularly recurring along the length of each filament, and out of phase from filament to filament.

The spun yarn of this example is particularly suited for being draw-textured using an aggregate friction false-twist device downstream from the primary heater for applying false twist, the draw ratio and aggregate speed being selected such that filaments are broken in or after the aggregate to yield a spun-like yarn (resembling a yarn spun from staple fibers) with protruding broken filaments. The regularity of recurrence of the high and low shrinkage regions permits better control of the number of broken filaments per meter of yarn by selection of the draw-texturing process conditions. The breadth of the shrinkage peaks and valleys also contribute in this regard. In yarns according to this aspect of the invention, an average of at least two broad shrinkage peaks separated by broad shrinkage valleys occur for each 5 meters along the filaments. In the specific yarn of this example, the 5 cm. shrinkage amplitude in the shrinkage valleys are below 20%, as is preferred when filaments are intended to be broken during a subsequent texturing process.

EXAMPLE IV

This is an example within the teachings of Example 3 of Japanese patent publication No. 22339/1967. A spinneret having 34 combined orifices is provided, each combined orifice being constituted by a central capillary having a diameter of 0.300 mm. and three satellite capillaries having diameters of 0.200 mm. The satellite capillaries are equally spaced apart around the central capillary with their centers 0.400 mm. from the center of the central capillary, and all capillaries have a length of 0.305 mm. Polyester polymer of normal molecular weight for apparel yarns is spun through the spinneret at a melt temperature of 300° C., at a rate of 73.5 grams per minute. The combined streams are conventionally quenched by transversely directed air into filaments at a spinning speed of 400 meters per minute and wound on a package.

The spun yarn is then conventionally drawn over a hot shoe heated to 90° C. at a draw ratio of 4.0 to yield a drawn yarn having a denier of 416, 33% elongation-to-break, tenacity of 2.7 grams per denier, shrinkage of 13.4% and crimp of 1.2%. The denier per filament is about 12, and fabric made from the yarn has poor cover and a harsh hand. This low level of crimp and the low value of the crimp-to-shrinkage ratio, makes the yarn far less valuable than yarns made according to the present invention.

Figure 12:
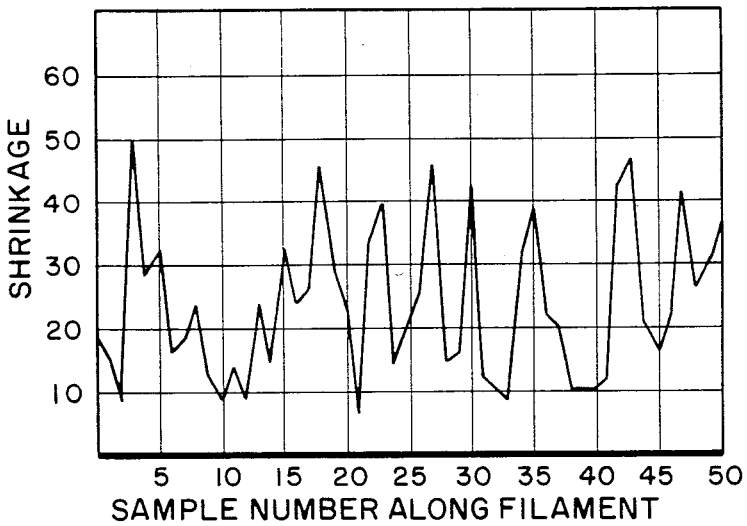
FIG. 12. (PRIOR ART)
FIG. 12 is a shrinkage profile of a filament made according to the teachings of Japanese patent publication No. 22339/1967.

The shrinkage profile along a filament from the drawn yarn has the random character depicted in FIG. 12. While a single broad shrinkage peak occurs at sample numbers 42 and 43, this is atypical of yarns spun in accordance with this example.

EXAMPLE V

The spun yarn in Example IV is experimentally drawn at a draw ratio of 3.2 to produce a drawn yarn having a denier of 515, elongation of 42%, tenacity of 1.6 grams per denier, shrinkage of 16.1% and a crimp of 3.0%. The denier per filament is about 15, and fabric made from the yarn also has poor cover and a harsh hand, as in Example III. While the crimp level is marginally useful, the undesirably low crimp-to-shrinkage ratio makes the yarn undesirable for many end uses. The shrinkage profile is again similar to FIG. 12.

EXAMPLE VI

When using any of the spinnerets referred to above, random occurrence of narrow shrinkage peaks and valleys of random amplitude along the length of the filaments is inherent when spinning at low speeds. As the spinning speed is increased above some level, a degree of regularity is achieved which is advantageous for various uses, as noted above in Example III. The spinning speed at which the almost wholly random character of the shrinkage profile changes to discernible regularity depends on spinneret design, polymer throughput rate, spun denier-per-filament, quenching conditions, and other similar parameters, and can readily be determined by simply increasing the spinning speed until the shrinkage profile displays substantial regularity. With the above spinnerets, ordinarily regularity becomes apparent in the vicinity of 1500–2500 meters per minute. With the FIG. 1 spinneret, regularity begins to be apparent at about 2000 ypm (about 1800 mpm) spinning speed. The degree of crimp and the crimp-to-shrinkage ratio also ordinarily increase substantially at spinning speeds far above the 400 meters per minute suggested in Japanese patent publication No. 22339/1967.

DEFINITIONS AND TEST METHODS

"Polyester" as used herein means those polymers of fiber-forming molecular weight composed of at least 85% by weight of an ester or esters of one or more dihydric alcohols and terephthalic acid.

The shrinkage profile (and 5 cm. shrinkages) are determined by separating from the yarn bundle a single filament 2.5 meters long, care being taken not to stretch the filament. The filament is then cut into consecutive serially numbered 5 cm. samples or segments, which are then placed while unrestrained in boiling water for 30 seconds. The length of each segment is then measured, and its shrinkage amplitude as a percentage of the original 5 cm. length is calculated. For example, if a segment has a length of 4.2 cm. after the treatment with boiling water, its shrinkage amplitude would be 16%. The percentage shrinkage amplitudes when plotted in serial number order, provides a profile of shrinkage variation along the filament. By a broad peak or valley is meat that at least two consecutive 5 cm. shrinkage amplitudes along an individual filament are above a given level in the case of a shrinkage peak, or are below a given level, in the case of a shrinkage valley.

In contrast to the above 5 cm. shrinkage test of individual filaments, yarn properties are determined in the following manner. The yarn is conditioned for at least one hour in an atmosphere of 22° C. and 65% relative humidity. If the yarn is wound on a package, at least 100 meters are stripped off and discarded. The yarn is skeined under a tension of 0.035 grams per denier on a Suter denier reel or equivalent device having a perimeter of 1.125 meters per revolution to a total skein denier of approximately (but not to exceed) 8000, and the ends are tied. For example, for a 170 denier yarn, 24 revolutions would give a skein denier of 8160. In this instance, 23 revolutions would be used. The skein is removed from the denier reel and suspended from a 1.27 cm. diameter round bar. A 1000 gram weight is gently lowered until the weight is suspended from the bottom of the skein by a bent #1 paper clip or equivalent piece of wire weighing less than 1 gram. After 30 seconds, the skein length is measured to the nearest 0.1 cm., the measured length being recorded as $L_o$. The 1000 gm. weight is then replaced with a 20 gm. weight, and the rod with the suspended skein and 20 gm. weight are placed in a 120° C. oven for 5 minutes. The rod with the suspended skein and 20 gm. weight is removed from the oven and conditioned for 1 minute at 22° C. and 65% relative humidity after which the skein length $L_1$ is determined to the nearest 0.1 cm. The 20 gm. weight is then carefully replaced by the 1000 gm. weight. Thirty seconds after the 1000 gm. weight has been applied, the skein length $L_2$ is determined to the nearest 0.1 cm. The percentage crimp is then calculated as $$(L_2-L_1/L_2)\times 100,$$

while the percentage yarn shrinkage is calculated as $$(L_o-L_2/L_o)\times 100.$$

Occasionally the filaments in a skein will be so highly entangled that, when the 20 gm. weight is replaced by the 1000 gm. weight, the length $L_2$ is about the same as $L_1$, even though the skein obviously has not had its crimp pulled out. In such a case, the 1000 gm. weight may be gently jarred until the weight falls and removes the crimp. To characterize a yarn, 100 samples are tested by the procedures in this paragraph, the highest 10 and lowest 10 values being discarded and the remainder averaged to arrive at crimp and shrinkage values for the yarn.

What is claimed is:

1. An as-spun self-crimping yarn comprising a plurality of polyester continuous filaments,
   (a) said filaments having non-round cross-sectional areas which vary substantially regularly along the lengths of said filaments from regions of large cross-sectional area to regions of small cross-sectional area, said variation in cross-sectional area being more than ±10% about a mean value,
   (b) said regions of large and small cross-sectional area being out of phase from filament to filament to thereby form said self-crimping yarn.

2. The yarn defined in claim 1, wherein said variation in cross-sectional area is at least ±30% about said mean value.

3. The yarn defined in either of claims 1 or 2, wherein said regions of large cross-sectional area have substantially higher shrinkage than said regions of small cross-sectional area whereby said filaments have shrinkage profiles in the form of shrinkage peaks in said regions of large cross-sectional area and shrinkage valleys in said regions of small cross-sectional area.

4. The yarn defined in claim 3, wherein said shrinkage profiles are in the form of an average of at least two broad shrinkage peaks per 5 meters along the length of each of said filaments, said peaks and valleys being out of phase from filament to filament.

5. The yarn defined in claim 4, wherein at least one of said filaments has an average denier less than 5.

6. The yarn defined in claim 3 wherein each of said polyester continuous filaments has a shrinkage of less than 30%.

7. The yarn defined in claim 6 wherein each of said polyester continuous filaments has a shrinkage of less than 10%.

* * * * *